US005118144A

United States Patent [19]

Garofalo, Jr.

[11] Patent Number: 5,118,144

[45] Date of Patent: Jun. 2, 1992

[54] GARBAGE CAN LID LATCH

[76] Inventor: Robert Garofalo, Jr., 124 Lalley Blvd., Fairfield, Conn. 06430

[21] Appl. No.: 804,953

[22] Filed: Dec. 11, 1991

[51] Int. Cl.[5] ..... B65D 45/16

[52] U.S. Cl. ..... 292/87; 220/324; 292/288

[58] Field of Search ..... 292/80, 87, 85, 91, 292/202, 204, 288, DIG. 12, DIG. 30; 220/322, 323, 324

[56] References Cited

U.S. PATENT DOCUMENTS

| | | | |
|---|---|---|---|
| 1,077,235 | 10/1913 | Wagandt . | |
| 1,207,974 | 12/1916 | Miller . | |
| 1,271,230 | 7/1918 | Sabo . | |
| 1,482,931 | 2/1924 | Keehn | 220/324 |
| 2,039,764 | 5/1936 | Barth | 292/87 |
| 2,220,318 | 11/1940 | Curtis | 292/87 |
| 2,742,679 | 4/1956 | Young . | |
| 2,756,084 | 7/1956 | Fraser | 292/87 |
| 2,974,990 | 3/1961 | Mereness | 292/288 |
| 3,104,903 | 9/1963 | Futch et al. | 292/87 |
| 3,137,408 | 6/1964 | Taylor | 292/87 |
| 3,152,716 | 10/1964 | Feldhahn | 220/31 |
| 3,158,393 | 11/1964 | King | 292/288 |
| 3,275,363 | 9/1966 | Bates et al. | 292/288 |
| 3,844,597 | 10/1974 | Elrod . | |
| 4,021,073 | 5/1977 | Manning | 296/137 B |
| 4,119,239 | 10/1978 | Anderson | 220/224 |
| 4,202,574 | 5/1980 | Redmayne | 292/288 |
| 4,214,782 | 7/1980 | Boyer | 292/87 |
| 4,501,378 | 2/1985 | Berfield | 292/87 |

FOREIGN PATENT DOCUMENTS

| | | | |
|---|---|---|---|
| 1452499 | 9/1966 | France | 220/324 |
| 59407 | 4/1912 | Switzerland . | |
| 185903 | 9/1922 | United Kingdom | 220/55 R |
| 669485 | 4/1950 | United Kingdom . | |

*Primary Examiner*—Eric K. Nicholson
*Attorney, Agent, or Firm*—Kramer, Brufsky & Cifelli

[57] ABSTRACT

Latching members made of single strips of resilient material which can be removably attached to the rim of a conventional metal garbage can receptacle at spaced locations along the rim. The resilient strips are bent in a substantially U-shaped configuration to form clips having a substantially arcuate or cylindrical bight portion with an entranceway or mouth whose width is less than the diameter of the bight so that it can be snapped over the rim of a garbage can lid. One of the U-shaped resilient strips can pivot on the lid rim so that one leg can be positioned beneath the lip or upper beaded portion of the can to preclude removal of the lid from the can when used in combination with the other, resilient clips mounted on the lower beaded portion of the garbage can lid, with a leg beneath the can bead. The outer leg of the first resilient U-shaped clip is angularly bent so that upon pushing downwardly on the leg the cylindrical bight can be pivoted on the bead on the lid enabling the inner leg adjacent the bead on the upper portion of the can to clear the bead on the can so that the lid can be raised and pivoted about the other clips to remove the lid to gain access to the interior of the can. Upon replacement of the lid on the top of the can, the inner leg of each of the U-shaped clips is biased and pushed towads the inner surface of the can lid until it clears the bead on the upper portion of the can, and because of the resiliency of each of the U-shaped clips, the inner legs will return to their original position and engage the underside of the bead on the upper portion of the can to lock the lid securely in place to prevent accidental removal.

11 Claims, 2 Drawing Sheets

GARBAGE CAN LID LATCH

BACKGROUND OF THE INVENTION

1. Field of the Invention

This invention relates to a locking mechanism, and more particularly, a latch for securing garbage can lids to garbage cans.

2. Description of the Prior Art

It is recognized that in many suburban communities, the disposal of refuse and garbage presents a problem in that individual householders must provide for the storage of these waste products for periods of time varying from several hours up to a week depending on the frequency with which collections are made by the local agency charged with the disposal of these materials. As a practical matter, refuse and garbage is usually stored in large metal containers kept outside of the dwelling house and unless the cover of such a receptacle is securely fastened, these receptacles attract the attention of stray dogs and cats, or other animals, such as raccoons, in the vicinity during the evening or early morning hours. Quite frequently, these marauders succeed in removing the cover, upsetting the receptacle and distributing the contents about the immediate area to create an unsightly and unsanitary condition.

A variety of lid latches have been proposed in the prior art, but all of them have various disadvantages that the present invention is intended to overcome. For example, many latches require multiple elements such as springs stretching across the diameter of the lid to retain the latch in locking position and thus are inconvenient and unwieldy to use. Examples of such latches are shown in U.S. Pat. Nos. 2,974,990 and 1,207,974. Many latches must be affixed to a lid of the garbage can in a substantially permanent manner with the result that the latch mechanism may have to be thrown away if the can or lid is worn out or damaged. An example of such a latch is shown in U.S. Pat. No. 3,104,903. Finally, some latch mechanisms may require additional clamping elements such as magnets or set screws to retain the latch in clamping relation on the garbage can lid. Examples of such constructions are shown in U.S. Pat. Nos. 3,275,363 and 4,202,574. Furthermore, these latches require coil spring mechanisms to return the latch to its lock position after the lid is opened and then replaced on the garbage can. The present invention avoids many of these disadvantages of the prior art.

SUMMARY OF THE INVENTION

The present invention contemplates the provision of novel latching members made of single strips of resilient material which can be removably attached to the rim of a conventional metal garbage can receptacle at spaced locations along the rim. The resilient strips are bent in a substantially U-shaped configuration to form clips having a substantially arcuate or cylindrical bight portion with an entranceway or mouth whose width is less than the diameter of the bight so that it can be snapped over the rim of a garbage can lid. One of the U-shaped resilient strips can pivot on the lid rim so that one leg can be positioned beneath the lip or upper beaded portion of the can to preclude removal of the lid from the can when used in combination with the other resilient clips mounted on the lower beaded portion of the garbage can lid, with a leg beneath the lid bead. However, the outer leg of the first resilient U-shaped clip is angularly bent so that upon pushing downwardly on the leg the cylindrical bight can pivot on the bead on the lid enabling the inner leg adjacent the bead on the upper portion of the can to clear the bead on the can so that the lid can be raised and pivoted about the other clips to remove the lid to gain access to the interior of the can. Upon replacement of the lid on the top of the can, the inner leg of each of the U-shaped clips is biased and pushed towards the inner surface of the can lid until it clears the bead on the upper portion of the can, and because of the resiliency of each of the U-shaped clips, the inner legs will return to their original position and engage the underside of the bead on the upper portion of the can to lock the lid securely in place to prevent accidental removal.

BRIEF DESCRIPTION OF THE DRAWINGS

Further objects and advantages of the invention will become more apparent from the following description and claims, and from the accompanying drawings, wherein:

DETAILED DESCRIPTION OF THE PREFERRED EMBODIMENT

Figure 1:
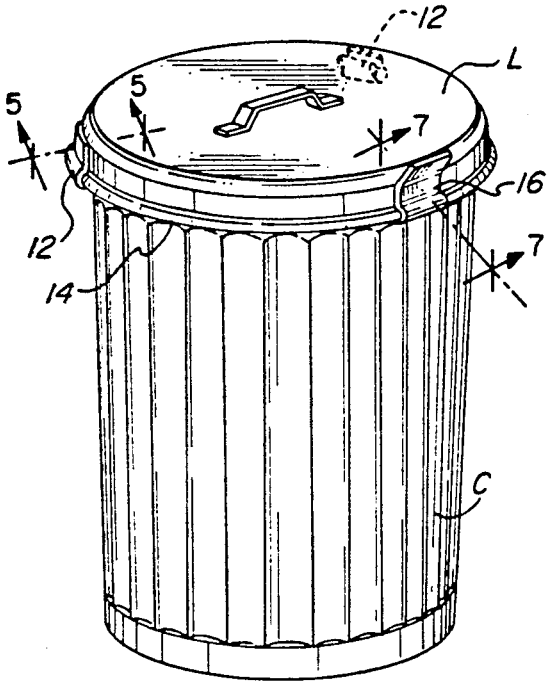
FIG. 1 is a perspective view of a garbage can with a lid locked to the can using the latch mechanism of the present invention.
Figure 2:
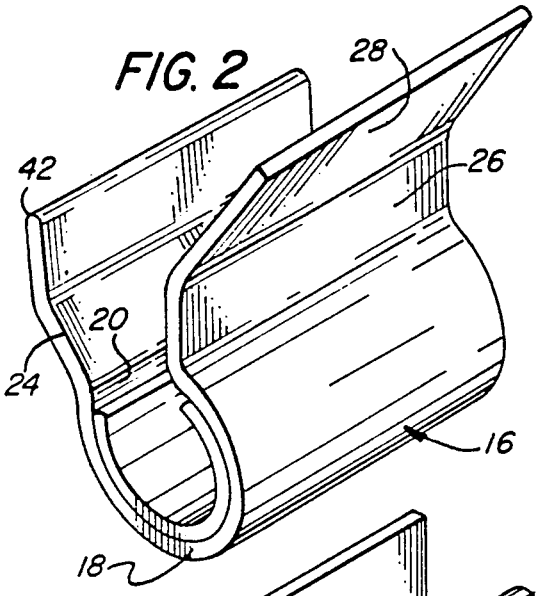
FIG. 2 is a perspective view of one type of U-shaped clip adapted to be pivotally mounted on the bead of the garbage can lid and forming a portion of the latch mechanism of the present invention, the clip being utilized to open and close the latch mechanism to permit and preclude removal of the lid from the can.
Figure 3:
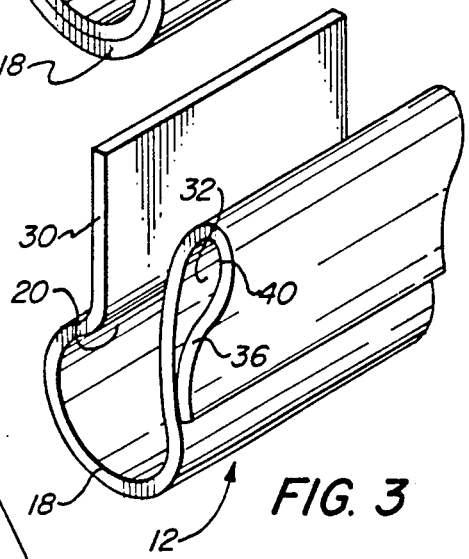
FIG. 3 is a perspective view of a non-rotatable, second type of U-shaped clip removably mounted at triangulated points relative to the U-shaped clip of FIG. 2 along the beaded rim of the garbage can lid to form with the clip of FIG. 2 the latch mechanism of the present invention.
Figure 4:
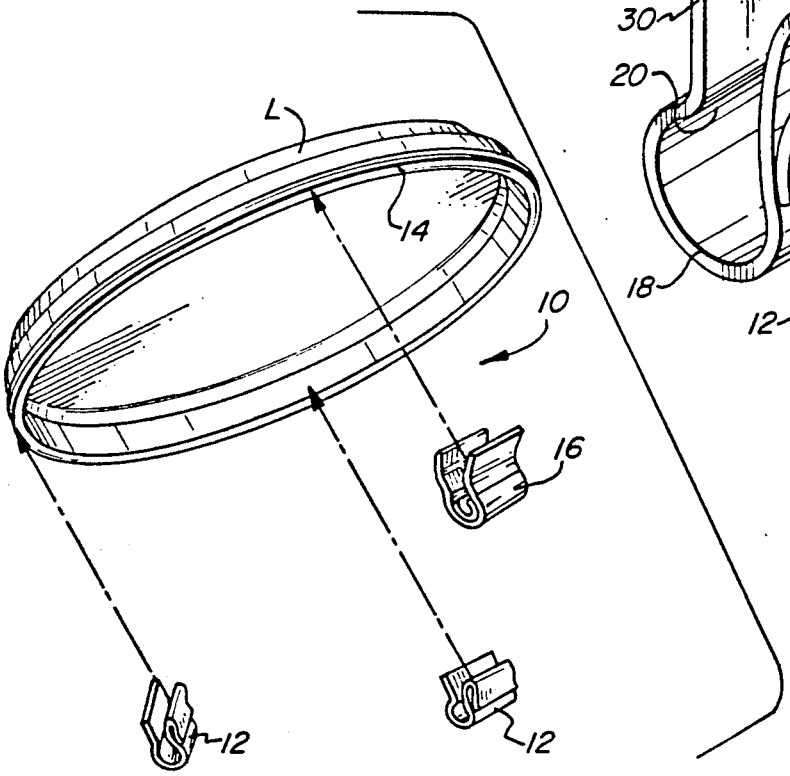
FIG. 4 is an exploded perspective view illustrating the location and manner of mounting the U-shaped clips of FIG. 2 and FIG. 3 at space points along the circumference of a garbage can lid to form the latch mechanism of the present invention.

Referring now to the drawings in detail, wherein like numerals indicate like elements throughout the several views, the latching mechanism 10 of the present invention includes a pair of stationary clips 12 mounted on the annular bead or rim 14 of a garbage can lid L at spaced locations around the circumference of the rim 14, at approximately a third of the circumference. A pivotable clip 16 is also mounted on rim 14 equidistant between clips 12 to form the complete latch mechanism 10.

Each of the clips 12 and 16 is formed from a single strip of resilient material which can be removably attached to the rim of the conventional metal garbage can receptacle lid L. The resilient strips 12,16 are bent in a substantially U-shaped configuration having a substantially arcuate or cylindrical bight portion 18 with an entranceway or mouth 20 whose width is less than the diameter of the bight 18 so that it can be snapped over the rim 14 of a garbage can lid L.

Figure 7:
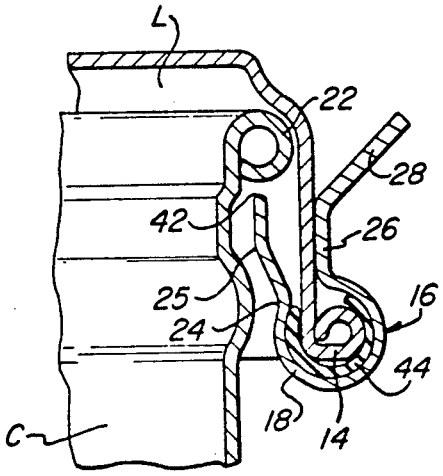
FIG. 7 is a cross-sectional view taken substantially along the plane indicated by line 7—7 of FIG. 1.
Figure 8:
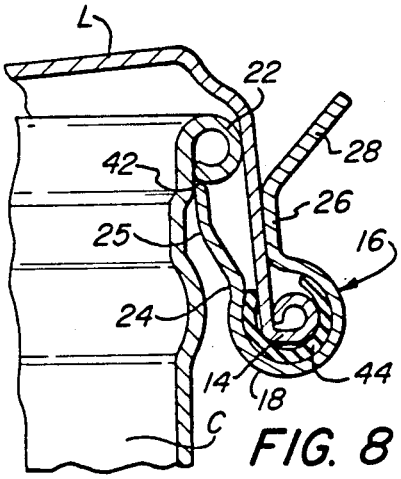
FIG. 8 is a view similar to FIG. 7 but illustrating the operation of the U-shaped clip latch element of FIG. 2 to preclude removal of the lid from the can.
Figure 9:
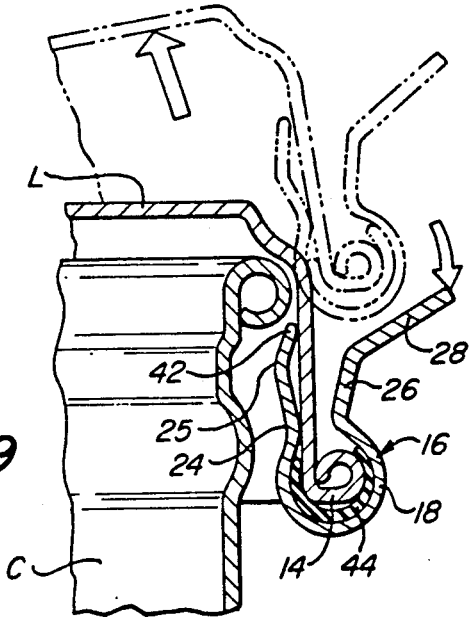
FIG. 9 is a view similar to FIGS. 7 and 8, but illustrating the repositioning of the U-shaped clip latch element of FIG. 2 on the lid so that the lid can be removed as indicated in phantom lines in FIG. 9.

The U-shaped resilient strip 16 can pivot on the lid rim 14 so that one leg can be positioned beneath the lip or upper annular beaded portion 22 of the can C to preclude removal of the lid L from the can C when used in combination with clips 12 mounted in a triangular array on the lower beaded portion or rim 14 of the garbage can lid L. In order to enable clip 16 to pivot on rim 14, the inner leg 24 and outer leg 26 of clip 16 diverge at an acute angle from opposite ends of bight portion 18 and are not parallel. This permits leg 24 to engage the underside of bead 22 of can C, when leg 26 is flush with the outer circumference of lid L, as shown in FIGS. 7 and 8. Attempts to raise the lid L, as shown in FIG. 8 will cause leg 24 to contact and interfere with bead 22 to prevent removal of lid L. Moreover, the outer leg 26 of U-shaped bracket 16 is angularly bent at its end portion 28 remote from bight 18 at an obtuse angle so that upon pushing downwardly on the leg portion 28, the cylindrical bight 18 can be pivoted on the rim 14 on the lid L enabling the inner leg 24 adjacent the bead 22 on the upper portion of the can C to clear the bead 22 on the can so that the lid can be raised and pivoted as shown in FIG. 9, to gain access to the interior of the can. The inner leg 24 can be rounded as shown at 25 to facilitate clearing bead 22.

Figure 5:
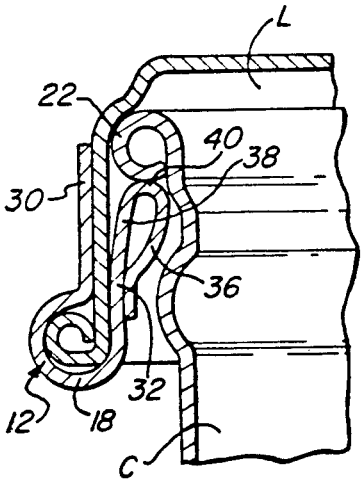
FIG. 5 is a cross-sectional view taken substantially along the plane indicated by line 5—5 of FIG. 1 and illustrating the manner of operation of the U-shaped clip of FIG. 3 to preclude removal of the garbage can lid from the garbage can.

The stationary clips 12 include, as compared to clip 16, substantially parallel inner and outer legs 30,32, respectively, extending upwardly from opposite ends of its bight portion 18. The inner leg 32 is bent back about itself to form a thickened end portion 36 and a portion 38 adjacent bend 40 slightly spaced from the interior circumferential wall of lid L when clip 12 is snapped over rim 14. As indicated in FIG. 5, when the lid L is seated on the top of can C the bend 40 of leg portion 38 is positioned beneath bead 22 to aid in preventing removal of lid L, when clip 16 is in the position shown in FIGS. 7 and 8.

However, when leg portion 28 of clip 16 is pushed downwardly, as shown in FIG. 9, leg 26 is moved away from lid L and bight 18 is thereby rotated to position inner leg 24 in contact with the interior surface of lid L, the lid L can be raised as indicated in phantom in FIG. 9 because the rounded end 25 of leg 24 will clear bead 22. The top surface 42 of leg 24 also can be rounded, if desired, to further aid clearance as the lid L is raised and pivoted about bead 22 at the mounting locations of clips 12 o lid L. The lid L is tilted until the leg portions 36 on each clip 12 clear bead 22 upon pivoting of the lid, permitting complete raising and removal of the lid L from can C.

Figure 6:
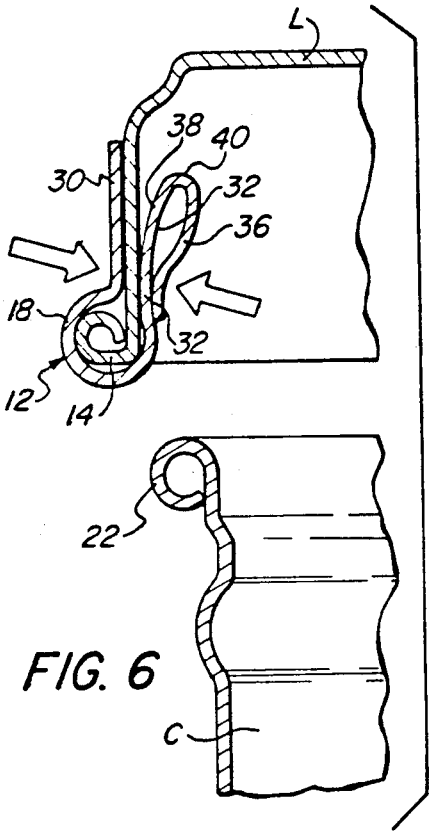
FIG. 6 is an exploded view similar to FIG. 5 but showing the manner in which the clip of FIG. 3 is activated to effect a locking action beneath the upper bead of the garbage can upon seating of the lid on the upper bead of the garbage can.

Upon replacement of the lid L on the top of the can C, the inner legs 24,36 of the U-shaped brackets 16 and 12, respectively, are biased and pushed towards the inner surface of the can lid L until they clear the bead 22 on the upper portion of the can C (see FIGS. 6 and 9, respectively). Because of the resiliency of the clips 12 and 16 positioned triangularly about the circumference of the lid L, the inner legs 32 and 24, respectively, will return to their original position and engage the underside of the bead 22 on the upper portion of the can C to lock the lid securely in place to prevent accidental removal. In the case of clip 12, this resiliency is aided by the slight space between leg portion 38 and the inner circumference of lid L and in the case of clip 16 by the rerotation imparted to leg 24 upon release of angled end portion 28 to space the leg 24 slightly from the inner circumference of lid L and its subsequent movement towards the circumference when the lid is repositioned on the can C.

A semi-cylindrical rubber sleeve 44 can be inserted between the bight portion 18 of clip 16 and annular rim 14 of the lid L to frictionally retard rotation of the clip on the rim 14 upon pressing downwardly on leg portion 28 so that the clip will return more readily to the position of FIG. 7 once the lid L is removed from the can C. If desired, semi-cylindrical rubber devices can similarly be employed with respect to clips 12 to prevent them from rotating around the rim of the lid and to maintain equal spacing of the clips around the rim of the lid.

What is claimed is:

1. A latching mechanism for releasably securing a lid having a circumferential depending flange to a container having an outwardly extending beaded rim, said mechanism comprising, in combination:

a plurality of U-shaped members each having a substantially cylindrical bight portion provided with a mouth of less width than the diameter of said bight portion adapted to be snapped over the flange on said lid at circumferentially spaced locations on said lid, one of said U-shaped members being pivotable on said lid flange and having a pair of upwardly extending legs, one of which includes a terminal portion bent at an obtuse angle to the remainder of said leg to form a handle for pivoting said U-shaped member, the other leg of said one U-shaped member extending at an acute angle to said first leg whereby said second leg may be positioned beneath the outwardly extending rim of said can so that upon upward movement of said lid, said second leg contacts said rim to preclude removal of said lid, but upon pivoting said U-shaped member by pushing on said handle portion of said first leg, said second leg can be pivoted along with the bight portion of said member so that said leg will not contact said outwardly extending flange on said can, thereby permitting pivoting of said lid about said other U-shaped members and removal of said lid from said can.

2. The latching mechanism of claim 1 wherein each of said other U-shaped members of said latching mechanism has first and second leg members extending upwardly from a bight portion, one of said leg members being adapted to contact the flange on the upper portion of said can.

3. A latching mechanism in accordance with claim 1 including an arcuate rubber sleeve inserted within the bight portion of said one U-shaped latch member to frictionally retard rotation of said member on said lid.

4. The latching mechanism of claim 2 wherein said other of said U-shaped members includes an end portion of said second leg bent back upon itself to increase the thickness of said leg to form an interference surface in contact with the flange on the upper portion of said can.

5. The latching mechanism of claim 1 wherein the second leg of said one U-shaped member includes a rounded portion to facilitate rotation past said flange extending outwardly from said upper surface of said can upon opening of said latch to remove said lid.

6. The latching mechanism of claim 1 wherein said U-shaped members are placed on the flange of said lid at circumferentially spaced locations on said lid forming the apices of a triangle.

7. The latching mechanism of claim 3 wherein each of said other U-shaped members of said latching mechanism has first and second leg members extending upwardly from a bight portion, one of said leg members being adapted to contact the flange on the upper portion of said can.

8. The latching mechanism of claim 4 including an arcuate rubber sleeve inserted within the bight portion of said one U-shaped latch member to frictionally retard rotation of said member on said lid.

9. The latching mechanism of claim 5 wherein each of said other U-shaped members of said latching mechanism has first and second leg members extending upwardly from a bight portion, one of said leg members being adapted to contact the flange on the upper portion of said can.

10. The latching mechanism of claim 9 wherein said other of said U-shaped members includes an end portion of said second leg bent back upon itself to increase the thickness of said leg to form an interference surface in contact with the flange on the upper portion of said can.

11. The latching mechanism of claim 5 including an arcuate rubber sleeve inserted within the bight portion of said one U-shaped latch member to frictionally retard rotation of said member on said lid.

* * * * *